US008720914B1

(12) United States Patent
Heath et al.

(10) Patent No.: US 8,720,914 B1
(45) Date of Patent: May 13, 2014

(54) SAFETY WALKER

(71) Applicants: Alan C. Heath, Winter Springs, FL (US); Sherrie Heath, Winter Springs, FL (US)

(72) Inventors: Alan C. Heath, Winter Springs, FL (US); Sherrie Heath, Winter Springs, FL (US)

( * ) Notice: Subject to any disclaimer, the term of this patent is extended or adjusted under 35 U.S.C. 154(b) by 0 days.

(21) Appl. No.: 13/669,057

(22) Filed: Nov. 5, 2012

(51) Int. Cl.
*A61H 3/04* (2006.01)

(52) U.S. Cl.
USPC ..... 280/87.021; 280/87.05; 135/67; 135/74

(58) Field of Classification Search
USPC ..... 280/87.021, 87.041, 87.05; 135/67, 74, 135/912; 220/407, 561, 564
See application file for complete search history.

(56) References Cited

U.S. PATENT DOCUMENTS 1,361,102 A * 12/1920 Scott ..... 482/67
2,224,246 A * 12/1940 Ames ..... 297/6
2,313,944 A * 3/1943 Keener et al. ..... 224/201
2,798,533 A * 7/1957 Frank ..... 297/6
3,354,893 A * 11/1967 Schmerl ..... 135/67
4,272,071 A * 6/1981 Bolton ..... 482/67
4,342,465 A 8/1982 Stillings
4,345,790 A * 8/1982 Coe ..... 297/6
4,415,198 A * 11/1983 Brearley ..... 297/6
4,449,750 A * 5/1984 Pultman ..... 312/235.2
4,491,257 A * 1/1985 Ingles ..... 224/407
4,621,804 A * 11/1986 Mueller ..... 280/87.041
4,770,410 A 9/1988 Brown
4,830,243 A * 5/1989 Mann ..... 224/407
4,953,851 A * 9/1990 Sherlock et al. ..... 482/66
4,974,620 A * 12/1990 Quillan et al. ..... 135/67
5,058,912 A * 10/1991 Harroun ..... 280/87.021
5,071,192 A * 12/1991 Adler ..... 297/464
5,228,708 A 7/1993 Verdugo
5,351,700 A * 10/1994 Jones et al. ..... 135/67
5,392,802 A * 2/1995 Farr et al. ..... 135/66
5,443,304 A * 8/1995 Fochs ..... 297/467
5,476,432 A * 12/1995 Dickens ..... 482/67
5,704,682 A * 1/1998 Gorayeb et al. ..... 297/5
5,979,476 A * 11/1999 Cranny ..... 135/67
6,068,273 A * 5/2000 Rao et al. ..... 280/87.041
6,170,840 B1 * 1/2001 Mathias ..... 280/87.041
6,371,142 B1 * 4/2002 Battiston ..... 135/67
6,401,996 B1 * 6/2002 Thom et al. ..... 224/407
6,527,285 B1 * 3/2003 Calandro, II ..... 280/87.051
6,595,530 B2 * 7/2003 Wood ..... 280/42
6,948,727 B1 * 9/2005 Bakken ..... 280/87.021
7,494,139 B2 * 2/2009 Turner et al. ..... 280/87.021
7,506,657 B2 * 3/2009 Hsiao ..... 135/67
7,588,043 B1 * 9/2009 Bais ..... 135/67
7,735,499 B1 * 6/2010 Pennise ..... 135/67

(Continued)

FOREIGN PATENT DOCUMENTS

CN 202223701 U * 5/2012

*Primary Examiner* — John Walters
*Assistant Examiner* — Steve Clemmons
(74) *Attorney, Agent, or Firm* — Crossley Patent Law; Micah C. Gunn

(57) ABSTRACT

A safety walker that provides a padded top member, a plurality of telescopic legs, a plurality of crossbars between the legs, a removable mesh seat, and a latchable door having a padded upper bar attached atop a U-shaped support base along with accessory attachments, including a holder frame for an oxygen tank, a table, and a receptacle bag. In addition to the telescopic legs, a hinge is disposed at each rear corner of the top member as well as between the crossbars to provide collapsibility.

1 Claim, 6 Drawing Sheets

(56) References Cited

U.S. PATENT DOCUMENTS

| | | | | |
|---|---|---|---|---|
| 7,950,405 | B2 * | 5/2011 | Turner et al. | 135/67 |
| 8,122,527 | B2 * | 2/2012 | Ruttler | 4/484 |
| 8,166,988 | B1 * | 5/2012 | Martin | 135/67 |
| 2005/0121481 | A1 * | 6/2005 | Chiu | 224/407 |
| 2005/0183759 | A1 * | 8/2005 | Wolfe | 135/67 |
| 2007/0267551 | A1 * | 11/2007 | Townsend | 248/125.8 |
| 2007/0278271 | A1 * | 12/2007 | Koren | 224/407 |
| 2008/0007020 | A1 * | 1/2008 | Holman | 280/87.051 |
| 2008/0190947 | A1 * | 8/2008 | Bourgraf | 220/737 |
| 2013/0140781 | A1 * | 6/2013 | Prather | 280/47.38 |

* cited by examiner

SAFETY WALKER

BACKGROUND OF THE INVENTION

Various types of safety walkers are known in the prior art. However, what is needed is a safety walker that provides a padded top member, a plurality of telescopic legs, a plurality of crossbars between the legs, a removable mesh seat, and a latchable door having a padded upper bar attached atop a U-shaped support base along with accessory attachments, including a holder frame for an oxygen tank, a table, and a receptacle bag.

FIELD OF THE INVENTION

The present invention relates to walking aid devices, and more particularly, to a safety walker having a padded top member, a plurality of telescopic legs, a plurality of crossbars between the legs, a removable mesh seat, and a latchable door having a padded upper bar attached atop a U-shaped support base.

SUMMARY OF THE INVENTION

The general purpose of the present safety walker, described subsequently in greater detail, is to provide a safety walker which has many novel features that result in a safety walker which is not anticipated, rendered obvious, suggested, or even implied by prior art, either alone or in combination thereof.

To accomplish this, the present safety walker provides a safe, sturdy and convenient walker device that permits freedom of movement for an elderly person, a handicapped individual, or a physically challenged person while providing protection from falling in any direction. The present safety walker includes a unitary rigid frame. The frame has a U-shaped top member with a continuous padding and having an exterior wall, an interior wall, a front left edge, a front right edge and an aperture between the front left edge and the front right edge of the top member. A hinge is disposed at each rear corner of the top member and also between the crossmembers to assist in the collapsibility of the frame. A latchable door having a U-shaped support base is pivotally attached to the top member. A padded upper bar is attached to the support base to prevent injury to a user.

Telescopic legs are attached to the top member and inverted U-shaped crossbars, which include top crossbars and bottom crossbars, are disposed between each of legs. A wheel is attached each leg and a braking mechanism is attached to each wheel. A seat is removably attached to the crossbars. The seat is disposed in an opening centrally disposed within the frame. The seat is a trapezoidal mesh body that is attached to the crossbars with carabiners.

A holder frame configured to hold and secure an oxygen tank onto the frame, a table, and a receptacle bag removably engage the top member.

In addition to providing freedom of movement and protection from injurious falls while walking, the device also promotes exercise, unlike a wheelchair. The telescopic legs permit the present safety walker to be collapsed for portability. Thus has been broadly outlined the more important features of the present safety walker so that the detailed description thereof that follows may be better understood and in order that the present contribution to the art may be better appreciated.

BRIEF DESCRIPTION OF THE DRAWINGS FIGURES

DETAILED DESCRIPTION OF THE DRAWINGS

Figure 1:
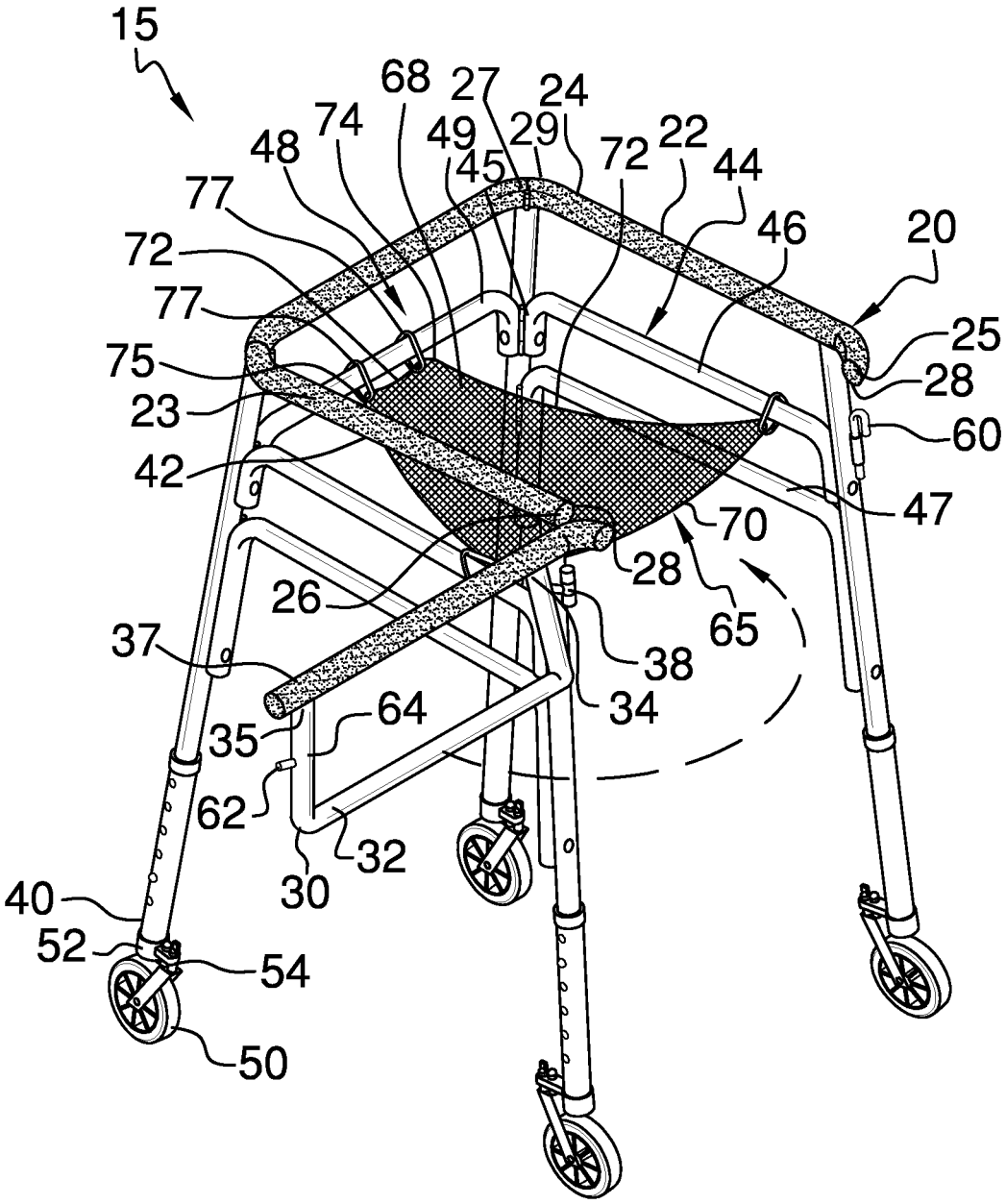
FIG. 1 is an isometric view with a door in an open position.
Figure 2:
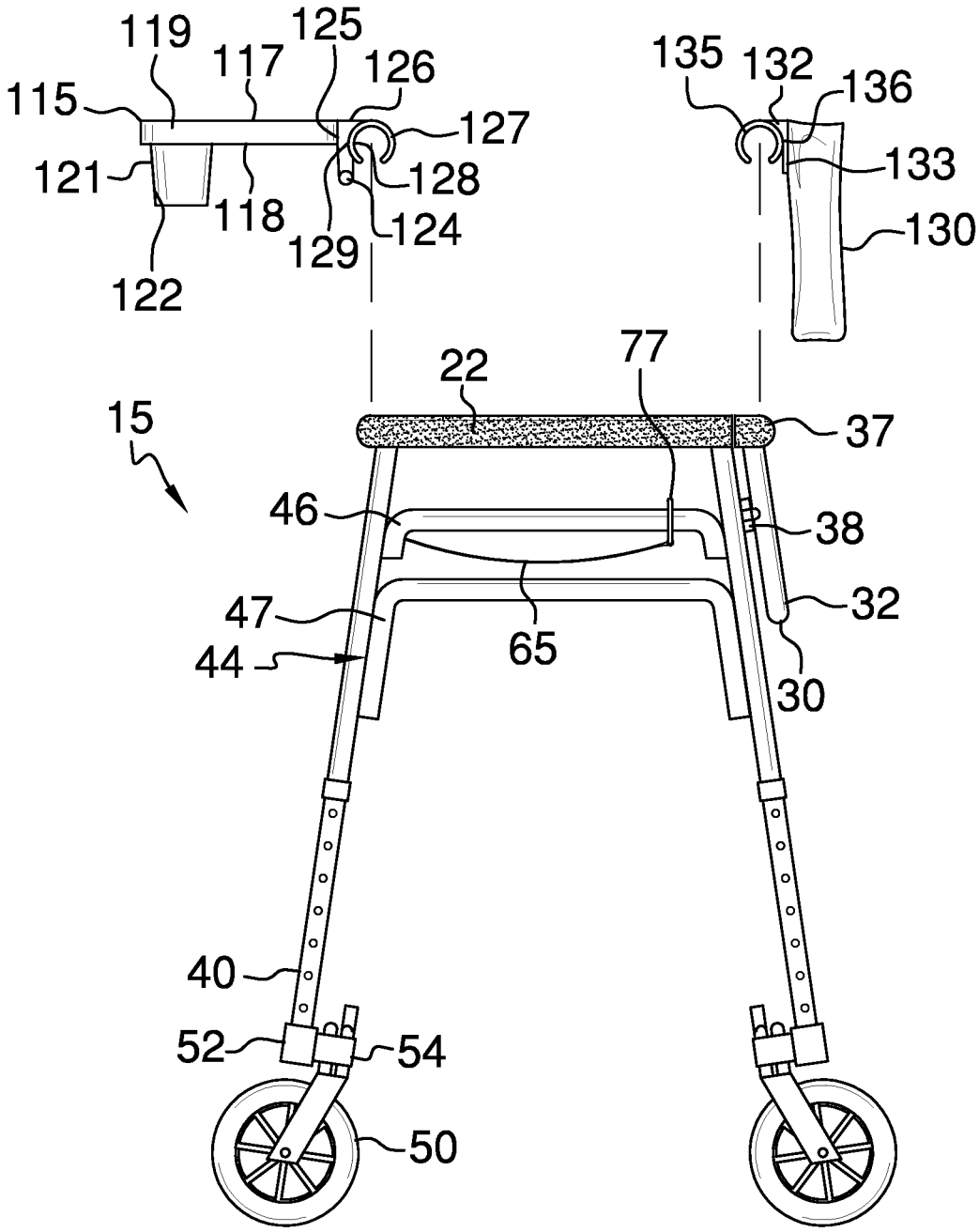
FIG. 2 is a side elevation view with the door in a closed position.
Figure 3:
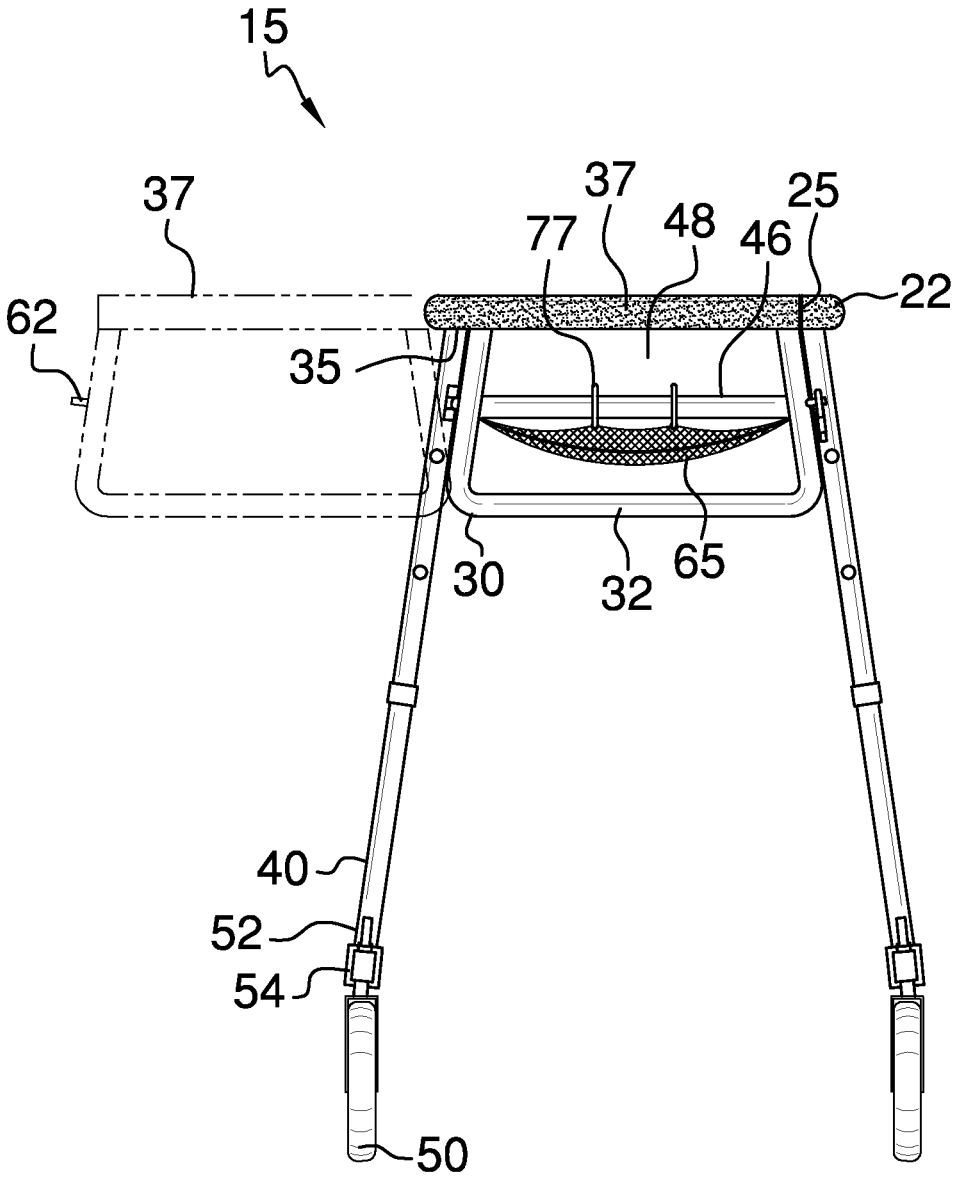
FIG. 3 is a rear elevation view.
Figure 4:
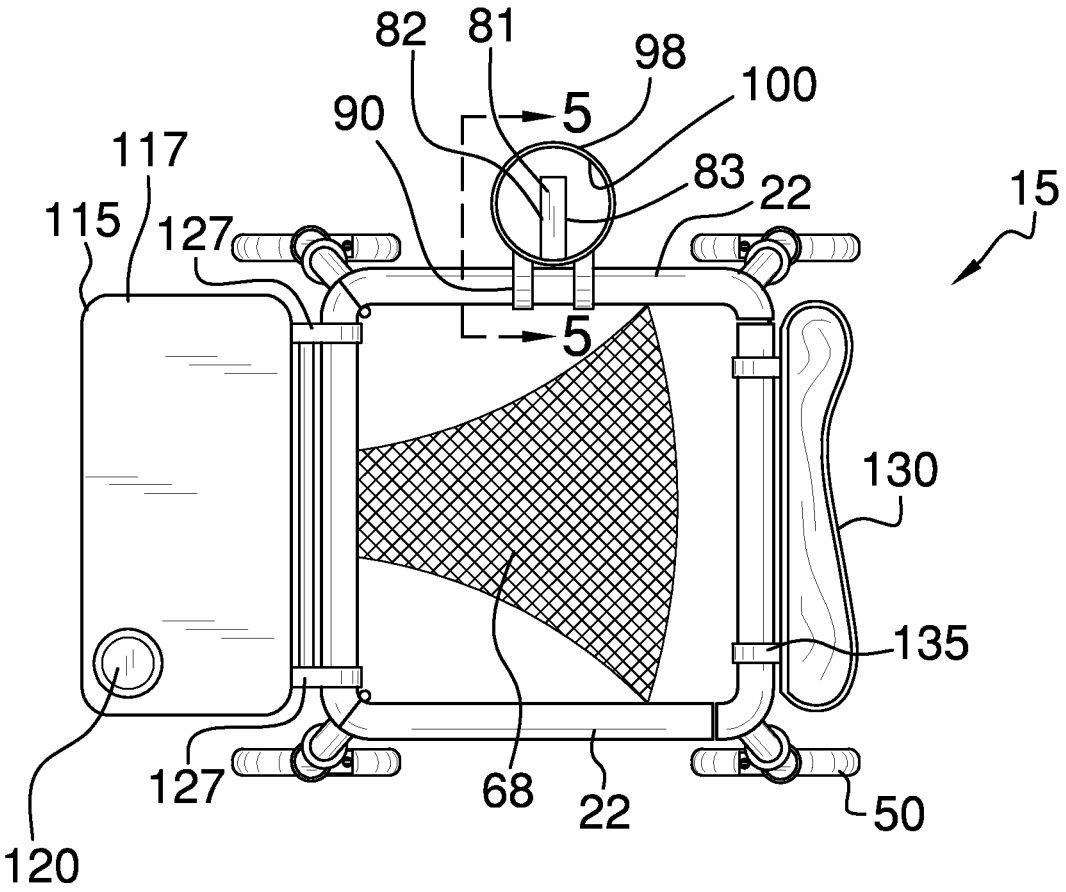
FIG. 4 is a top plan view illustrated with a table attachment, a holder frame attachment and a receptacle bag.
Figure 5:
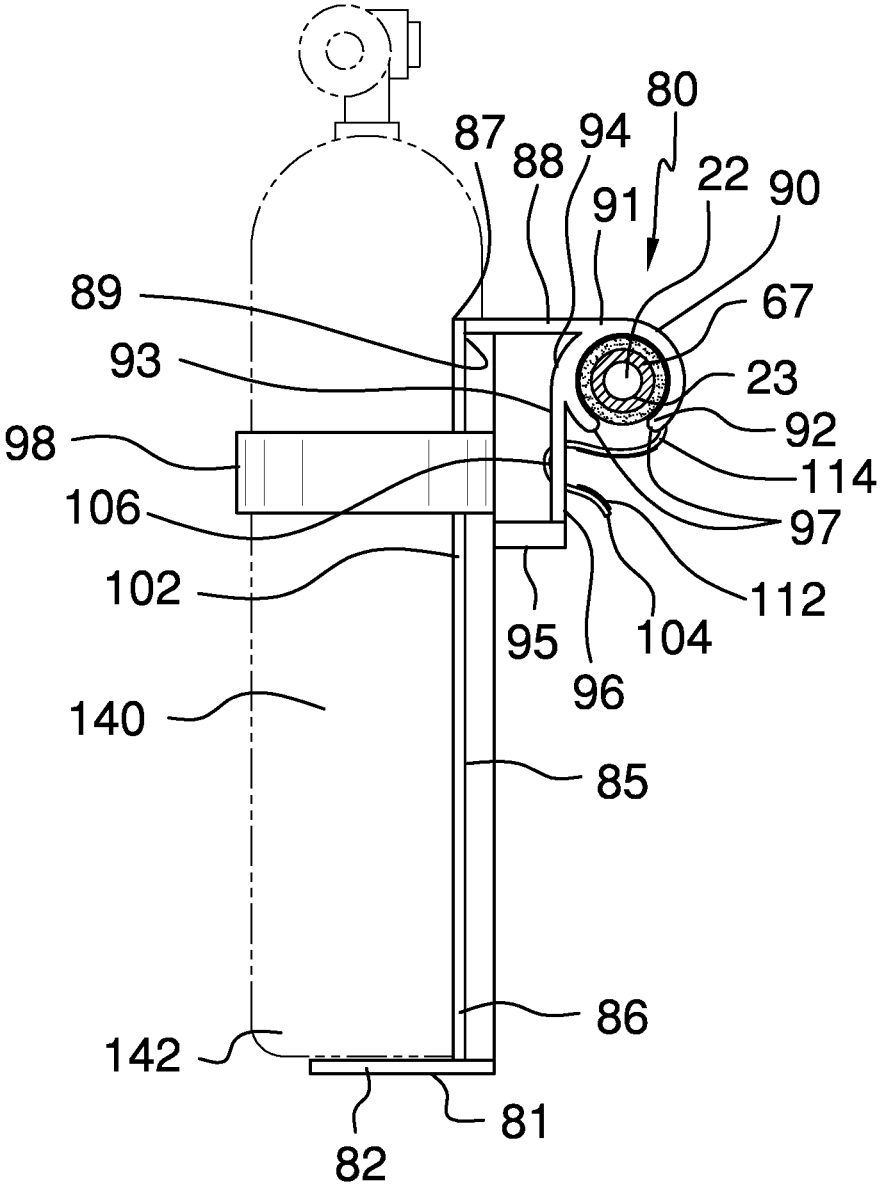
FIG. 5 is a detailed side elevation view of the holder frame.
Figure 6:
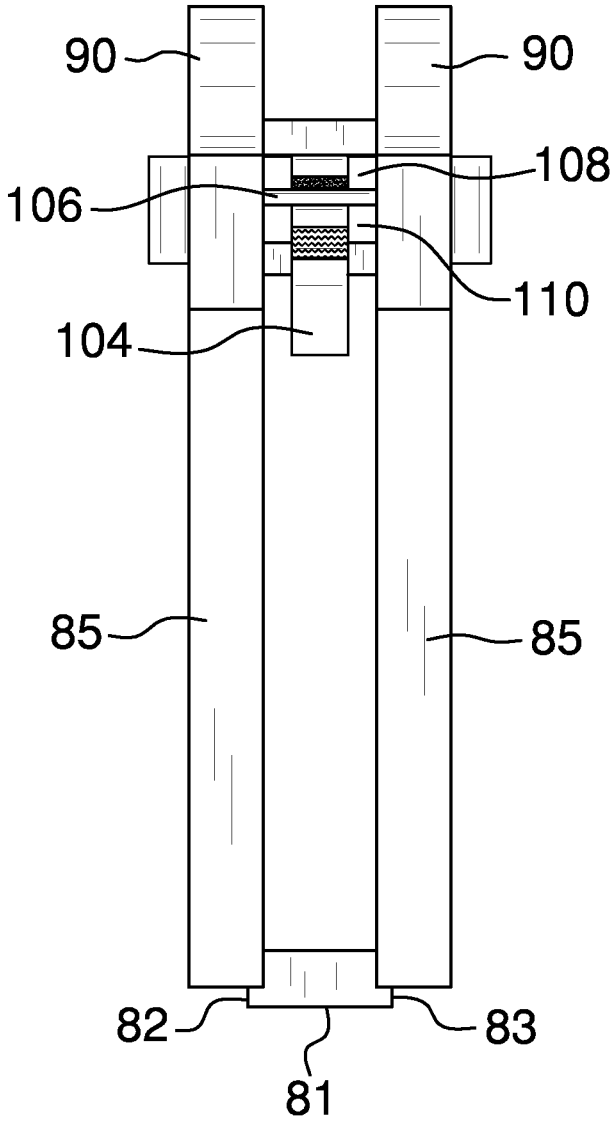
FIG. 6 is a front elevation view of the holder frame.

With reference now to the drawings, and in particular FIGS. 1 through 6 thereof, example of the instant safety walker employing the principles and concepts of the present safety walker and generally designated by the reference number 15 will be described.

Referring to FIGS. 1 through 6, a preferred embodiment of the present safety walker 15 is illustrated. The safety walker 15 includes a unitary rigid frame 20. The frame 20 has a U-shaped top member 22 having an exterior wall 23, an interior wall 24, a front left edge 25, a front right edge 26, and an aperture 28 between the front left edge 24 and the front right edge 26 of the top member 22. A first hinge 27 is disposed at each rear corner 29 of the top member 22 to permit collapsibility of the frame 20.

A door 30 is attached to the top member 22 of the frame 20. The door 30 includes a U-shaped support base 32 pivotally attached to one of the front left edge 25 and the front right edge 26. The U-shaped support base 32 has a first edge 34 and a second edge 35. A padded upper bar 37 is attached to the U-shaped support base 32. The upper bar 37 extends from at least from the first edge 34 to the second edge 35. The door 30 is configured to engage and alternately disengage the aperture 28 in a respective closed position and open position. A second hinge 38 pivotally attaches the support base 32 to one of the front left edge 25 and the front right edge 26 of the top member 22 of the frame 20. A length of padding 67 is disposed around the top member 22 interior wall 24. The padding 67 completely surrounds the exterior wall 23 of the top member 22. The top member 20 can have a circular, rectangular, or square horizontal cross-section.

The U-shaped top member 22 and the door 30 prevent a user from falling in any direction. The padded upper bar 37 and the length of padding 67 assist in preventing injury to a user.

A plurality of spaced apart telescopic legs 40 is attached to the top member 22 in a position extending downwardly from a bottom wall 42 of the top member 22. A pair of inverted U-shaped crossbars 44 is disposed between each of legs 40 except across the aperture 28. The crossbars 44 include a top crossbar 46 and a bottom crossbar 47 disposed in a position below the top crossbar 46. An opening 48 is centrally disposed within the frame 20 between an internal wall 49 of the crossbars 44 and the top member 22 interior wall 24. A third hinge 45 is disposed between each of the crossbars 44. The telescopic legs 40 and third hinge 45 also aid in collapsibility for portability.

A wheel 50 is attached to a bottom end 52 of each of the legs 40. A braking mechanism 54 is attached to each wheel 50. Each braking mechanism 54 is in operational communication with the respective wheel 50. Each braking mechanism 54 locks and alternately unlocks the respective wheel 50. The braking mechanisms 54 permit the wheels to be locked to allow a user to stand without moving, for support to prevent rolling of the device when grasping the device to stand prior to standing in the opening 48 within the frame 20, and to prevent the safety walker 10 from otherwise rolling away.

A door latch 60 is disposed on one of the legs 40 proximal to the front left edge 25 of the top member 22. A securement member 62 is disposed on an outer edge 64 of the door 30. The securement member 62 operationally engages and alternately disengages the door latch 60 in a locked position and in an alternate unlocked position. Upon the engagement of the securement member 62 and the door latch 60 in a locked position, the door 30 engages the aperture 28 in a closed position. Alternately, upon the disengagement of the securement member 62 and the door latch 60 in an unlocked position, the door 30 engages the aperture 28 in an open position.

A seat 65 is removably attached to the crossbars 44. The seat 65 is disposed in the opening 48 between the internal wall 49 of the crossbars 44 and the top member 22. The seat 65 includes a trapezoidal mesh body 68 having a front end 70, a pair of sides 71, and a rear end 72, each of the front end 70 and the rear end 72 having a first end 74 and a second end 75. A carabiner 77 is disposed on each of the first end 74 and the second end 75 of each of the front end 70 and the rear end 72. Each carabiner 77 removably engages a respective one of the crossbars 44. The trapezoidal shape of the seat permits a user's legs to more easily move while the device 10 is in use for walking than other shapes. The mesh body 68 permits air flow through the seat 65 thus keeping the seat 65 cooler than would a solid body and preventing sweating, thereby making the seat 65 more comfortable for a user.

The present apparatus 10 includes a holder frame 80, a table 115, and a receptacle bag 130, each of which removably engages the top member 22. The holder frame 80 includes a horizontal base 81 having a first side 82 and a second side 83. The base 81 is configured to support a lower end 142 of a personal oxygen tank 140 thereon. A pair of spaced apart vertical members 85 is disposed perpendicular to the base 81. Each of the vertical members 85 has a lower side 86 disposed on the base 81 and an upper side 87. One of the vertical members 85 is disposed proximal the first side 82 and the other of the vertical members 85 is disposed proximal the second side 83. A horizontal first member 88 is disposed on the upper side 87 of each of the vertical members 85 on a forward side 89 thereof and perpendicular thereto. A C-shaped attachment member 90 is disposed on an outer end 91 of each first member 88. Each attachment member 90 has a breach 97 disposed on a lowermost side 92 thereof. Each attachment member 90 is configured to removably attach to the top member 22. An extension 93 is vertically disposed on an inside edge 94 of each attachment member 90 proximal the breach 97 in a position parallel to the vertical member 85. A horizontal second member 95 is disposed on a bottom side 96 of each extension 93 in a position parallel to the respective first member 88. An annular support member 98 is disposed in a position parallel to the base 81 and the first members 88. An inner wall 100 of the support member 98 is disposed on an outer wall 102 of each of the vertical members 85. The holder frame 80 and the support member 98 are configured to secure the oxygen tank 140 in a vertical position upon the placement of the oxygen tank 140 atop the base 81 and within the support member 98. The structure of the holder frame 80 permits a sturdy securement of the oxygen tank 140 to the rigid frame 20.

A self-securing strap 104 is attached to an outermost wall of each attachment member 90 proximal the breach 97. A crossmember 106 is disposed within each extension 93. Each strap 104 engages an upper aperture 108 disposed above the crossmember 106 and a lower aperture 110 disposed below the crossmember 106. Each strap 104 has a distal edge 112 engaging a proximal portion 114 of the strap 104. Each strap 104 closes the breach 97 upon securement of the distal edge 112 to the proximal portion 114 to further secure the holder frame 80 to the top member 22.

The table 115 includes an upper surface 117, a lower surface 118, and a continuous wall 119 therebetween. A cavity 120 is disposed through the upper and lower surfaces 117, 118. The table 115 further includes an extended hollow cup holder body 121 having a continuous exterior wall 122, which has substantially a same diameter as a diameter of the cavity 120. A pair of spaced-apart legs 124 is disposed on a frontal end 125 of the wall 119 in a position perpendicular thereto. Each leg 124 has a top surface 126 coplanar to the upper surface 117. A C-shaped bracket 127, which removably engages the top member 22, has a rear side 128 attached to a forward wall 129 of each leg 124.

The receptacle bag 130 includes a stabilizer bracket member 132 attached to an outer side 133 of the receptacle bag 130. A pair of C-shaped clamps 135 is attached to an outermost edge 136 of the stabilizer bracket member 132. The clamps 135 removably engage the door 30 upper bar 37 and alternately can removably engage the top member 22 because a diameter of each of the upper bar 37 is that same as the diameter of the top member 22.

What is claimed is:

1. A safety walker comprising:

a unitary rigid frame having a top member and an aperture in a front side of the top member;

a first hinge disposed at each of a rear corner of the top member;

a door pivotally attached to the top member of the frame, wherein the door is configured to engage and alternately disengage the aperture in a respective closed position and open position;

a plurality of spaced apart telescopic legs attached to the top member in a position extending downwardly from a bottom wall of the top member;

at least one crossbar disposed between each of legs except across the aperture;

a third hinge disposed between each of the crossbars;

an opening centrally disposed within the frame between an internal wall of the crossbars and an interior wall of the top member;

a wheel attached to a bottom end of each of the legs;

a braking mechanism attached to each of the wheels, each braking mechanism in operational communication with the respective wheel, wherein each braking mechanism locks and alternately unlocks the respective wheel;

the door hingedly attached to the top member, wherein the door has a door latch disposed on one of the legs proximal to the front of the top member;

a securement member disposed on an outer edge of the door, wherein the securement member operationally engages and alternately disengages the door latch in a locked position and in an alternate unlocked position, wherein upon the engagement of the securement member and the door latch in a locked position, the door engages the aperture in the closed position, further wherein upon the disengagement of the securement member and the door latch in an unlocked position, the door engages the aperture in the open position;

a seat removably attached to the crossbars, wherein the seat is disposed in the opening between the crossbars;

a length of padding continuously disposed around the top member, the padding completely surrounding the exterior wall of the top member;

a padded upper bar disposed on the door;

wherein the seat comprises:

a trapezoidal mesh body having a front end, a pair of sides, and a rear end, each of the front end and the rear end having a first end and a second end; and a carabiner disposed on each of the first end and the second end of each of the front end and the rear end, wherein each carabiner removably engages a respective one of the crossbars;

a holder frame removably engaging the top member, wherein the holder frame comprises:

a horizontal base having a first side and a second side, wherein the base is configured to support a lower end of a personal oxygen tank thereon;

a pair of spaced apart vertical members disposed perpendicular to the base, each of the vertical members having a lower side disposed on the base and an upper side, one of the vertical members disposed proximal the first side and the other of the vertical members disposed proximal the second side;

a horizontal first member disposed on the upper side of each of the vertical members on a forward side thereof and perpendicular thereto;

a C-shaped attachment member disposed on an outer end of each first member, each attachment member having a breach disposed on a lowermost side thereof, wherein each attachment member is configured to removably attach to the top member;

an extension vertically disposed on an inside edge of each attachment member proximal the opening in a position parallel to the vertical member;

a horizontal second member disposed on a bottom side of each extension in a position parallel to the respective first member;

an annular support member disposed in a position parallel to the base and the first members, wherein an inner wall of the support member is disposed on an outer wall of each of the vertical members;

wherein the holder frame and the support member are configured to secure the oxygen tank in a vertical position upon the placement of the oxygen tank atop the base and within the support member;

a self-securing strap attached to an outermost wall of each attachment member proximal the breach; and a crossmember disposed within each extension, wherein each strap engages an upper aperture disposed above the crossmember and a lower aperture disposed below the crossmember, wherein each strap has a distal edge engaging a proximal portion of the strap.

* * * * *